US010203624B2

(12) United States Patent
Hoshi et al.

(10) Patent No.: US 10,203,624 B2
(45) Date of Patent: Feb. 12, 2019

(54) IMAGE FORMING APPARATUS

(71) Applicants: Shotaro Hoshi, Kanagawa (JP); Yoshinori Nakagawa, Kanagawa (JP); Hiroki Atari, Kanagawa (JP)

(72) Inventors: Shotaro Hoshi, Kanagawa (JP); Yoshinori Nakagawa, Kanagawa (JP); Hiroki Atari, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 5 days.

(21) Appl. No.: 15/395,592

(22) Filed: Dec. 30, 2016

(65) Prior Publication Data

US 2017/0199484 A1 Jul. 13, 2017

(30) Foreign Application Priority Data

Jan. 13, 2016 (JP) ..... 2016-004725

(51) Int. Cl.
*G03G 15/00* (2006.01)
*G03G 15/01* (2006.01)
*G03G 21/00* (2006.01)

(52) U.S. Cl.
CPC ..... *G03G 15/0131* (2013.01); *G03G 15/55* (2013.01); *G03G 15/556* (2013.01);
(Continued)

(58) Field of Classification Search
CPC ..... G03G 15/1675; G03G 15/1605; G03G 15/1665; G03G 15/0189; G03G 15/065
See application file for complete search history.

(56) References Cited

U.S. PATENT DOCUMENTS

2002/0113856 A1* 8/2002 Suzuki ..... H04N 1/4015 347/133
2005/0154562 A1 7/2005 Matsuura et al.
(Continued)

FOREIGN PATENT DOCUMENTS

| | | |
|---|---|---|
| JP | 5-323746 | 12/1993 |
| JP | 2006-085033 | 3/2006 |
| JP | 2015-004970 | 1/2015 |

*Primary Examiner* — Walter L Lindsay, Jr.
*Assistant Examiner* — Jessica L Eley
(74) *Attorney, Agent, or Firm* — Oblon, McClelland, Maier & Neustadt, L.L.P.

(57) ABSTRACT

An image forming apparatus include a latent image bearer, charger, latent image forming unit, developing unit, receiver unit, transfer unit, information acquisition unit, and correction unit. The charger charges the latent image bearer with a predetermined charging potential. The latent image forming unit forms an electrostatic latent image on the latent image bearer. The developing unit develops the electrostatic latent image to form a toner image. The receiver unit receives the toner image from the talent image bearer. The transfer unit applies a predetermined transfer bias to transfer the toner image to the receiver unit. The information acquisition unit acquires residual image generation determination information. When predetermined residual image generation condition is satisfied, a correction unit corrects image forming condition such that surface potential unevenness of the latent image bearer subsequent to transfer is smaller than that generated where predetermined residual image generation condition is not satisfied.

12 Claims, 7 Drawing Sheets

(52) U.S. Cl.
CPC ..... *G03G 15/0189* (2013.01); *G03G 21/0011* (2013.01); *G03G 2215/00772* (2013.01); *G03G 2215/0164* (2013.01)

(56) References Cited

U.S. PATENT DOCUMENTS

| | | | | |
|---|---|---|---|---|
| 2005/0157327 | A1 | 7/2005 | Shoji et al. | |
| 2005/0281596 | A1 | 12/2005 | Nakagawa et al. | |
| 2005/0286916 | A1 | 12/2005 | Nakazato et al. | |
| 2006/0182451 | A1 | 8/2006 | Shoji et al. | |
| 2006/0210327 | A1* | 9/2006 | Iwakura ..... | G03G 15/0131 399/313 |
| 2007/0127934 | A1 | 6/2007 | Shoji et al. | |
| 2009/0052912 | A1 | 2/2009 | Shoji et al. | |
| 2010/0278558 | A1 | 11/2010 | Enoki et al. | |
| 2011/0164895 | A1 | 7/2011 | Ishikake et al. | |
| 2013/0004204 | A1* | 1/2013 | Hagiwara ..... | G03G 15/043 399/128 |
| 2014/0328603 | A1* | 11/2014 | Mizutani ..... | G03G 15/1605 399/21 |
| 2014/0341597 | A1 | 11/2014 | Urayama et al. | |
| 2014/0348521 | A1 | 11/2014 | Mase et al. | |
| 2015/0117884 | A1 | 4/2015 | Sugiyama et al. | |
| 2015/0139668 | A1 | 5/2015 | Sugiyama et al. | |
| 2015/0139674 | A1 | 5/2015 | Sugiyama et al. | |
| 2015/0331383 | A1 | 11/2015 | Takahashi et al. | |

* cited by examiner

FIG. 11
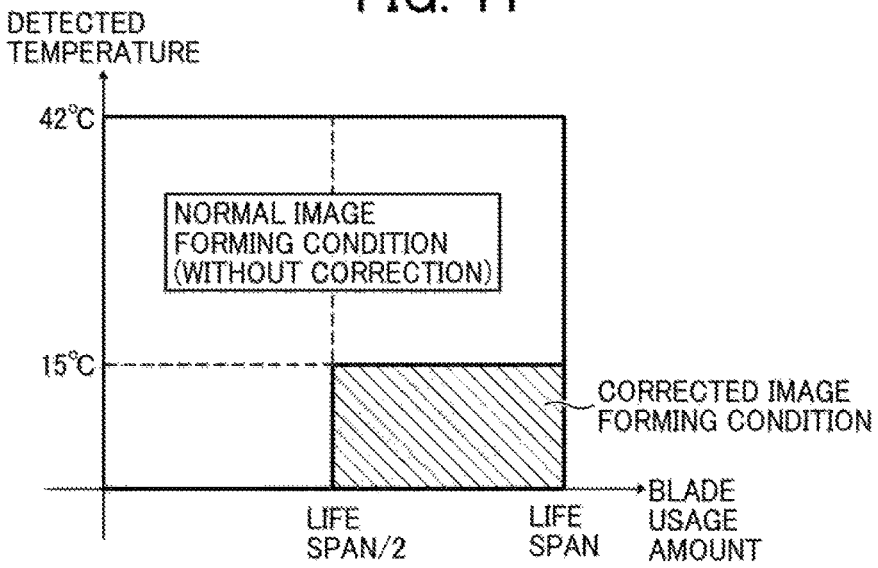
FIG. 12A
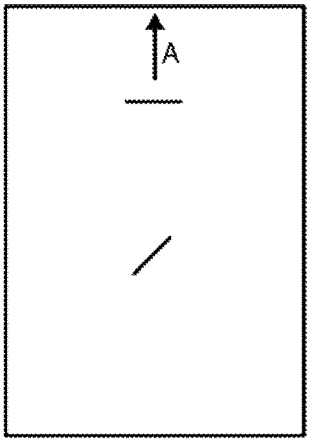
FIG. 12B
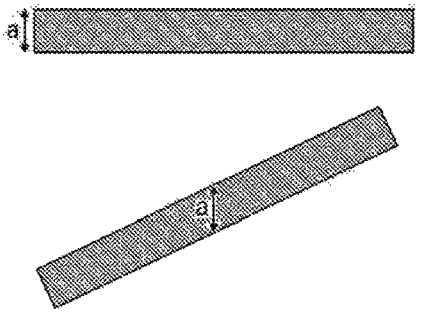
FIG. 13
| | UPPER LIMIT OF CHARGING POTENTIAL | PRIMARY TRANSFER VOLTAGE |
|---|---|---|
| NORMAL IMAGE FORMING CONDITION | 900V | 1400V |
| CORRECTED IMAGE FORMING CONDITION | 700V | 1300V |

IMAGE FORMING APPARATUS

CROSS-REFERENCE TO RELATED APPLICATION

This patent application is based on and claims priority pursuant to 35 U.S.C. § 119 to Japanese Patent Application No. 2016-004725, filed on Jan. 13, 2016, in the Japan Patent Office, the entire disclosure of which is hereby incorporated by reference herein.

BACKGROUND

Technical Field

Exemplary aspects of the present disclosure relate to an image forming apparatus.

Related Art

Electrophotographic image forming apparatuses for forming image, are known. Based on image information, the electrophotographic image form my apparatus forms an electrostatic latent image on a surface of a latent image carrier charged with a predetermined charging potential. Subsequently, the image forming apparatus allows toner to adhere to the electrostatic latent image to form a toner image, and transfers the toner image to a recording material or a receiver unit such as an intermediate transfer member.

SUMMARY

In at least one embodiment of this disclosure, there is provided an improved image forming apparatus that includes a latent image bearer, a charger, a latent image forming unit, a developing unit, a receiver unit, a transfer unit, an information acquisition unit, and a correction unit. The latent image bearer makes a surface movement. The charger performs a charging process to charge a surface of the latent image bearer with a predetermined charging potential. Based on image information, the latent image forming unit forms an electrostatic latent image on the surface of the image bearer subsequent to the charging process. The developing unit allows toner to adhere to the electrostatic latent image on the surface of the latent image bearer to form a toner image. The receiver unit receives the toner image from the surface of the latent image bearer. The transfer unit applies a predetermined transfer bias between the latent image bearer and the receiver unit to transfer the toner image on the surface of the latent image bearer to the receiver unit. The information acquisition unit acquires residual image generation determination information for determination of whether a predetermined residual image generation condition is satisfied. A correction unit corrects an image forming condition such that surface potential unevenness of the latent image bearer subsequent to transfer is smaller than surface potential unevenness generated where the predetermined residual image generation condition is not satisfied, when the image forming apparatus determines that the predetermined residual image generation condition is satisfied based on the residual image generation determination information acquired by the information acquisition unit.

BRIEF DESCRIPTION OF THE DRAWINGS

The aforementioned and other aspects, features, and advantages of the present disclosure would be better understood by reference to the following detailed description when considered in connection with the accompanying drawings, wherein;

FIG. 11 is a graph illustrating an area in which an image is formed under normal image forming conditions and an area in which an image is formed under corrected image forming conditions, where a horizontal axis indicates a blade usage amount and a vertical axis indicates a detected temperature;

FIG. 12A is a diagram of thin line images, and FIG. 12B is an enlarged view of the thin line images; and FIG. 13 is a summary table of the normal image forming conditions and the corrected image forming conditions.

Figure 1:
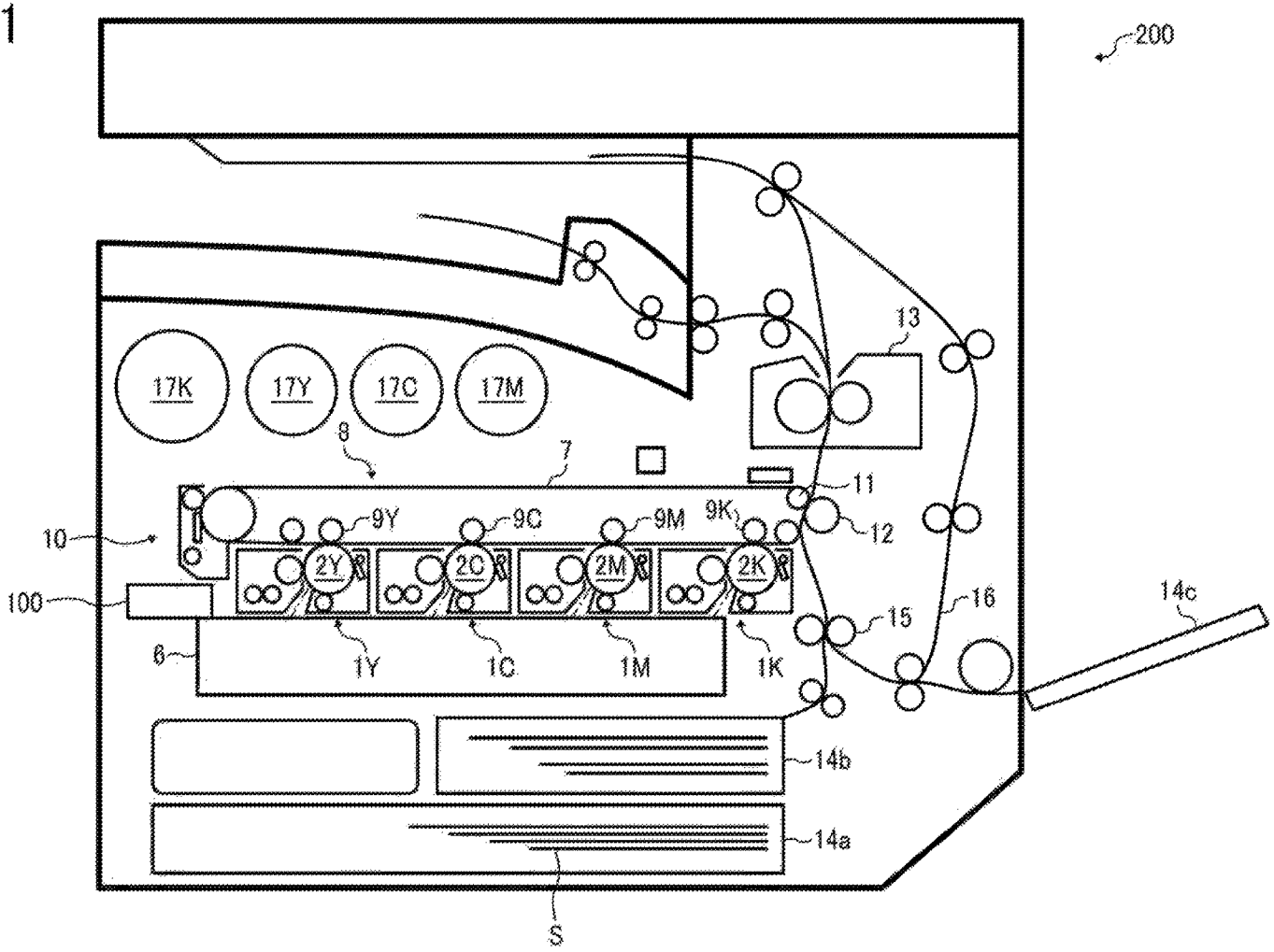
FIG. 1 is a schematic diagram illustrating a configuration of a printer as an image forming apparatus according to an exemplary embodiment.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the exemplary embodiments are described with technical limitations with reference to the attached drawings, such description is not intended to limit the scope of the disclosure and all of the components or elements described in the exemplary embodiments of this disclosure are not necessarily indispensable.

Referring now to the drawings, exemplary embodiments of the present disclosure are described below. In the drawings for explaining the following exemplary embodiments, the same reference codes are allocated to elements (members or components) having the same function or shape and redundant descriptions thereof are omitted below.

Hereinafter, an electrophotographic printer 200 is described as one example of an image forming apparatus according to an exemplary embodiment.

First, a basic configuration of the printer 200 is described with reference to FIG. 1.

The printer 200 includes four process units 1Y, 1C, 1M, and 1K that execute electrophotographic processes to form images of respective colors of yellow (Y), cyan (C), magenta (M), and black (K). Hereinafter the suffixes Y, C, M, and K to codes or numerical values indicate members for respective colors of yellow, magenta, cyan, and black. In FIG. 1, although the members for Y, C, M and K are arranged in this order, the color order is not limited thereto. The color order may be changed.

Figure 2:
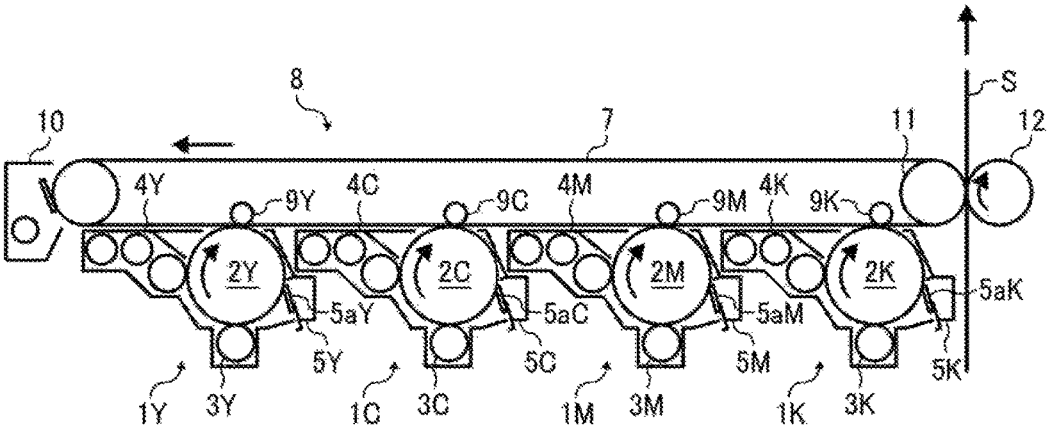
FIG. 2 is an enlarged view of four process units and a transfer unit in the printer.
Figure 3:
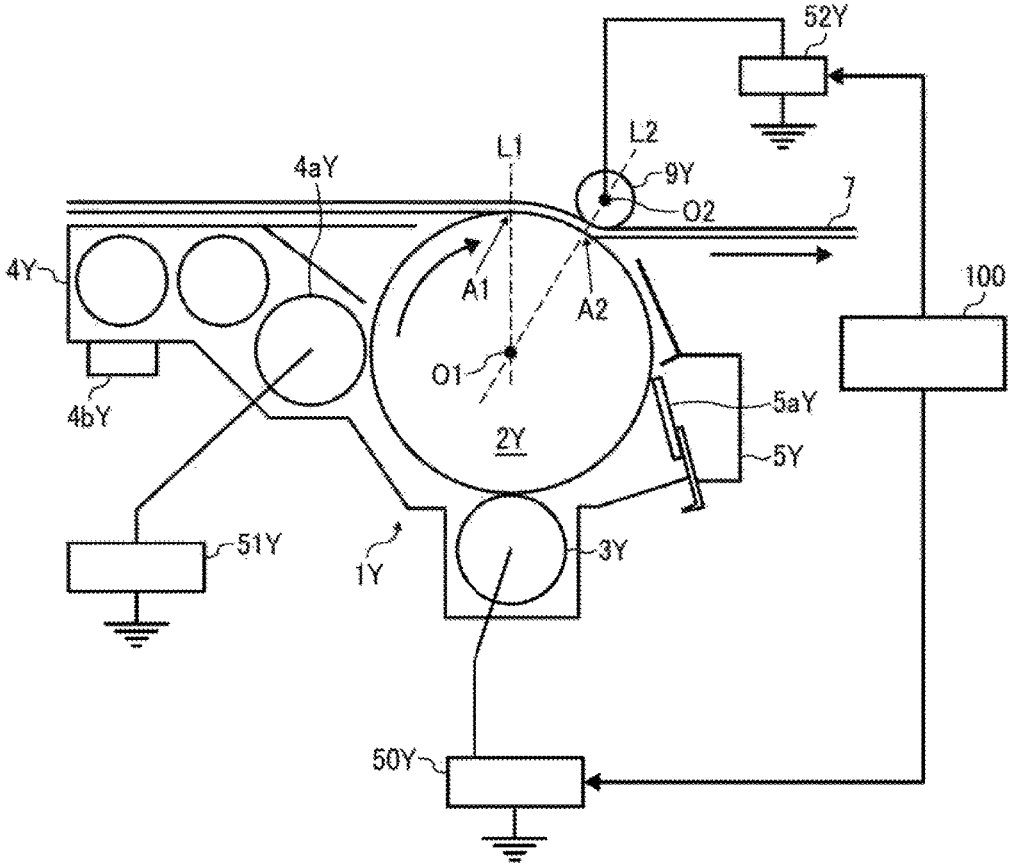
FIG. 3 is a diagram illustrating a configuration of a yellow process unit that is one of the four process units in the printer.

FIG. 2 is a an enlarged view of the process units 1Y, 1C, 1M, and 1K and a transfer unit 8 arranged in the printer 200. FIG. 3 is a diagram illustrating a configuration of the process unit 1Y. The process units 1Y, 1C, 1M, and 1K include respective drum-shaped photoconductors 2Y, 2C, 2M, and 2K as latent image bearers. The photoconductors 2Y, 2C, 2M and 2K are rotated clockwise in FIG. 2, so that toner images of the respective colors of Y, C, M, and K are formed on the surfaces of the photoconductors 2Y, 2C, 2M and 2K.

The transfer unit 8 is disposed above the process units 1Y, 1C, 1M, and 1K, and includes an endless intermediate transfer belt 7 as a receiver unit. The intermediate transfer belt 7 makes an endless movement in a counterclockwise direction as shown in FIG. 2. In a region in which an outer circumferential surface of the intermediate transfer belt 7 faces downward out of the entire circumference of the intermediate transfer belt 7, the photoconductors 2Y, 2C, 2M, and 2K contact the intermediate transfer belt 7 to form respective primary transfer nips for Y, C, M, and K. Moreover, primary transfer rollers 9Y, 9C, 9M, and 9K are arranged on an inner circumferential surface side of the intermediate transfer belt. The intermediate transfer belt 7 is nipped between the primary transfer rollers 9Y, 9C, 9M and 9K and the respective photoconductors 2Y, 2C, 2M, and 2K, thereby forming the primary nips for Y, C, M, and K. The primary transfer rollers 9Y, 9C, 9M, and 9K receive predetermined primary transfer voltage from respective transfer power sources. In particular, the primary transfer roller 9Y receives the primary transfer voltage from a transfer power source 52Y.

In general, arrangement of transfer rollers such as the primary transfer rollers 9Y, 9C, 9M, and 9K with respect to latent image bearers such as the photoconductors 2Y, 2C, 2M, and 2K is an important design parameter for a roller transfer method by which application of transfer voltage to the transfer roller transfers an image. Such a roller transfer method includes a direct application transfer method and an indirect application transfer method that differ in arrangement of the transfer roller with respect to the photoconductor. In the direct application transfer method, the transfer roller is positioned just opposite the photoconductor. In the indirect application transfer method, on the other hand, a position of the transfer roller is shifted (offset) toward a downstream side of a position in which the transfer roller is disposed just opposite the photoconductor in a direction of surface movement of the photoconductor (a direction of surface movement of the intermediate transfer belt 7).

The indirect application transfer method and the direct application transfer method are described in detail with reference to FIG. 3.

In FIG. 3, a description is given using an example of the primary transfer roller 9Y of the printer 200 including the intermediate transfer bell 7. In the indirect application transfer method, the primary transfer roller 9Y is disposed such that a point A2 on the surface of the photoconductor 2Y is positioned on a downstream side of a point A1 on the surface of the photoconductor 2Y in a direction of surface movement of the photoconductor 2Y on a virtual surface (a sheet surface in FIG. 3) perpendicular to a direction of surface movement of the photoconductor 2Y. The point A2 is provided on a virtual line L2 connecting a rotation center (a surface curvature center) O1 of the photoconductor 2Y to a rotation center O2 of the primary transfer roller 9Y. The point A1 on the surface of the photoconductor 2Y is nearest to the intermediate transfer belt 7 in a state in which the primary transfer roller 9Y is not disposed. In the direct application transfer method, on the other hand, the primary transfer roller 9Y is disposed such that a virtual line connecting a rotation center (a surface curvature center) O1 of the photoconductor 2Y to a rotation center O2 of the primary transfer roller 9Y is a line L1 on a virtual surface (a sheet surface in FIG. 3) perpendicular to a direction of surface movement of the photoconductor 2Y as illustrated in FIG. 3. That is, in the direct application transfer method, a point A1 that is on the surface of the photoconductor 2Y and through which the virtual line L1 connecting the rotation center (the surface curvature center) O1 of the photoconductor 2Y to the rotation center O2 of the primary transfer roller 9Y passes is substantially the same as a point A1 which is on the surface of the photoconductor 2Y and nearest to the intermediate transfer belt 7 in a state in which the primary transfer roller 9Y is not disposed.

In the exemplary embodiment, as illustrated in FIG. 3, the indirect application transfer method is employed for the primary transfer rollers 9Y, 9C, 9M, and 9K. In the indirect application transfer method, the intermediate transfer belt 7 is pressed to wind around the surfaces of the photoconductors 2Y, 2C, 2M, and 2K by the primary transfer rollers 9Y, 9C, 9M, and 9K to form the primary transfer nips necessary for the primary transfer. Hence, each of the primary transfer rollers 9Y, 9C, 9M, and 9K does not necessarily include a roller having an elastic layer made of rubber, for example. Accordingly, the primary transfer rollers 9Y, 9C, 9M, and 9K can include metal rollers having good durability or processing accuracy. In addition to such advantages, since the intermediate transfer belt 7 having low electric resistance can be used in the indirect application transfer method, manufacturing costs of the intermediate transfer belt 7 can be reduced. Hence, the indirection application transfer method has the advantage of lower cost over the direct application transfer method.

The intermediate transfer belt 7 extends across a plurality of rollers, and makes an endless movement in a counterclockwise direction as shown in FIG. 2 with rotation of at least one of the rollers. The transfer unit 8 includes a cleaning device 10 in addition to the intermediate transfer belt 7 and the primary transfer rollers 9Y, 9C, 9M, and 9K. The cleaning device 10 includes a brush roller and a cleaning blade. Moreover, the transfer unit 8 includes a secondary backup roller 11 and a secondary transfer roller 12.

The primary transfer rollers 9Y, 9C, 9M, and 9K receive a primary transfer voltage having a polarity opposite to a toner charge polarity from a transfer power source. Accordingly the primary transfer bias is applied to each of the primary transfer nips for Y, C, M, and K, and a primary transfer electric field is formed. The primary transfer electric fields electrostatically move the Y, C, M, and K toner images on the respective photoconductors 2Y, 2C, 2M, and 2K to the intermediate transfer belt 7. When making an endless movement, the intermediate transfer belt 7 sequentially passes the primary transfer nips for Y, C, M, and K. Meanwhile, the Y, C, M, and K toner images on the respective photoconductors 2Y, 2C, 2M, and 2K are sequentially overlapped and primarily transferred to the outer circumferential surface of the intermediate transfer belt 7. Thus, the toner image containing the overlapped toner images of tour colors is formed on the outer circumferential surface of the intermediate transfer belt 7.

As illustrated in FIG. 2, the secondary transfer roller 12 is disposed on the right side of the intermediate transfer belt 7. The secondary transfer roller 12 contacts the outer circumferential surface of the intermediate transfer belt 7 to form a secondary transfer nip. The intermediate transfer belt 7 is nipped between the secondary transfer roller 12 and the secondary backup roller 11 disposed on the inner circumferential surface side of the intermediate transfer belt 7, so that the secondary transfer nip is formed.

As illustrated in FIG. 3, the printer 200 includes a charging roller 3Y as a charger, a developing device 4Y as a developing unit, and a cleaner 5Y that are arranged around the photoconductor 2Y of the process unit 1Y. The charging roller 3Y rotates while contacting the surface of the photoconductor 2Y. The printer 200 employs a contact direct current (DC) charging method by which a DC voltage including only a DC component is applied to the charging roller 3Y from a charging power source 50Y. That is, the DC voltage excludes an alternating current (AC) component. Alternatively, the printer 200 can employ another method such as a contact AC charging roller method or a non-contact charging method for the charger.

The developing device 4Y stores a two-component developer containing a Y toner and a magnetic carrier. The developing device 4Y includes a developing roller 4*a*Y as a developer bearer disposed opposite the photosensitive member 2Y, a developing power source 51Y for applying a developing voltage to the developing roller 4*a*Y, a screw for conveying and agitating the developer, and a toner density sensor 4*b*Y. The developing roller 4*a*Y includes a rotatable sleeve to which the developing voltage is applied by the developing power source 51Y, and a magnet roller disposed inside such that the magnetic roller is not rotated with rotation of the sleeve. Although the developing device 4Y has been described, configurations of each of other developing devices 4C, 4M, and 4K are substantially similar to the configurations of the developing device 4Y except for the color of toner.

The cleaner 5Y of a blade type includes a cleaning blade 5*a*Y that contacts the surface of the photoconductor 2Y to clean excess toner such as residual transfer toner.

The process unit 1Y is attached to and detached from a printer body of the printer 200 in a state in which the photoconductor 2Y, the charging roller 3Y, the developing device 4Y, and the cleaner 5Y are supported as one unit by a common supporting member. Since the photoconductor 2Y and the components such as the charging roller 3Y, the developing device 4Y, and the cleaner 5Y arranged around the photoconductor 2Y are integrally attached to and detached from the printer body, maintainability can be more enhanced than with a case in which these units are individually attached and detached. Although the process unit 1Y has been described, configurations of each of the other process units 1C, 1M, and 1K ore substantially similar to the configurations of the process unit 1Y except for the color of toner.

In FIG. 1, the primer 200 includes an optical writing unit 6 disposed below the process units 1Y, 1C, 1M, and 1K. The optical writing unit 6 as a latent image forming unit includes a light source, a polygon mirror, an f-θ lens, and a reflection mirror to scan a surface of each of the photoconductors 2Y, 2C, 2M, and 2K with a laser beam based on image information of print data to be input. Such optical scanning forms electrostatic latent images of Y, C, M and K colors on the respective photosensitive members 2Y, 2C, 2M, and 2K.

Moreover, in FIG. 1, the printer 200 includes a fixing unit 13 as a fixing member disposed above the secondary transfer roller 12 of the transfer unit 8. The fixing unit 13 includes a fixing roller and a pressure roller that contact each other while rotating to form a fixing nip. The fixing roller includes a halogen heater, and electric power is supplied from a power source to the halogen heater such that a surface of the fixing roller has a predetermined temperature. The fixing nip is formed between the fixing roller and the pressure roller.

In a lower portion of the printer body as illustrated in FIG. 1, sheet feed cassettes 14*a* and 14*b*, a feed roller, and a registration roller pair 15 are arranged. In each of the sheet feed cassettes 14*a* and 14*b*, a plurality of sheets S as recording media on which images are to be recorded is stacked and stored. On a side of the printer body, a manual feed tray 14*c* is disposed so that a user can manually feed a sheet from the side. Moreover, in FIG. 1, a duplex unit 16 is disposed on the right side of the transfer unit 8 and the fixing unit 13. The duplex unit 16 conveys a recording sheet S to the secondary transfer nip again when the printer 200 forms images on two sides of the recording sheet S.

In an upper portion of the printer body, toner containers 17Y, 17C, 17M, and 17K are arranged. The toner containers 17Y, 17C, 17M, and 17K store the respective colors of toner, and respectively supply the toner to the process units 1Y, 1C, 1M and 1K. Moreover, the printer 200 includes a waste toner bottle and a power source unit.

To further an understanding of the present disclosure, an image forming operation performed by the printer 200 according to the exemplary embodiment is described. When the printer 200 receives a print job, each of the process units 1Y, 1C, 1M, and 1K starts an electrophotographic process. In the process unit 1Y, for example, the charging power source 50Y applies a charging voltage to the charging roller 3Y. With the application of the charging voltage to the charging roller 3Y, a charging bias is applied between the charging roller 3Y and the photoconductor 2Y to uniformly charge the surface of the photoconductor 2Y with a negative polarity. Subsequently, the optical writing unit 6 scans the uniformly charged surface of the photoconductor 2Y with the laser beam based on image information of the print job. Thus, a charging potential on an area (a latent image area) of the photoconductor 2Y irradiated with the laser beam becomes smaller, and an electrostatic latent image is formed. Such a surface of the photoconductor 2Y bearing the electrostatic latent image reaches a position opposite the developing device 4Y with the rotation of the photoconductor 2Y. Since a developing voltage is applied to the developing roller 4*a*Y disposed opposite the photoconductor 2Y, a developing bias is applied between the photoconductor 2Y and the developing roller 4*a*Y. As a result, a development electric field that moves the Y toner charged with the negative polarity to the latent image area on the surface of the photoconductor 2Y is formed, so that the electrostatic latent image on the surface of the photoconductor 2Y is developed as a Y toner image. The toner container 17Y replenishes the developing device 4Y with an appropriate amount of the Y toner according to an output of the tones density sensor 4*b*Y.

Similarly, the process units 1C, 1M, and 1K perform such operation at prescribed times to respectively form C, M, and K toner images on the surfaces of the photoconductors 2Y, 2C, 2M and 2K. In the primary transfer nips for Y, C, M, and K as described above, the Y, C, M, and K toner images are sequentially overlapped and primarily transferred to the outer circumferential surface of the intermediate transfer belt 7, thereby forming an image containing the overlapped images of four colors.

Meanwhile, after starting the print job, the printer 200 feeds a recording sheet S from any of the sheet feed cassettes 14*a* and 14*b* and the manual feed tray 14*c*. When the recording sheet S reaches the registration roller pair 15, the conveyance of the recording sheet S temporarily stops. With rotation of the registration roller pair 15, the recoding sheet S is fed toward the secondary nip at a prescribed time. The image containing the overlapped toner images of four colors on the intermediate transfer belt 7 is secondarily transferred to the sheet S in the secondary nip. When the secondary transfer is performed, a voltage having a polarity opposite (a positive polarity) to the toner to the secondary transfer roller 12 is applied by a secondary transfer power source.

After passing the secondary transfer nip, the recording sheet S is conveyed toward the fixing unit 13 and nipped in the fixing nip where the toner image on the recording sheet S is fixed with heat and pressure from the fixing roller. When single-sided printing is performed, the recording sheet S with the fixed toner image is discharged outside the primer 200 by conveyance rollers. On the other hand, when duplex printing is performed, the recording sheet S is conveyed to the duplex unit by conveyance rollers and reversed, so that an image is formed on the other side of the recording sheet S. Then, the recording sheet S is discharged outside the printer body.

Next, a residual image generation pattern is described.

Figure 4A:
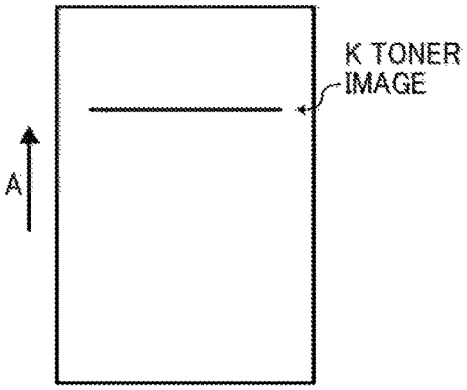
FIG. 4A is a diagram illustrating an image that is normally formed.
Figure 4B:
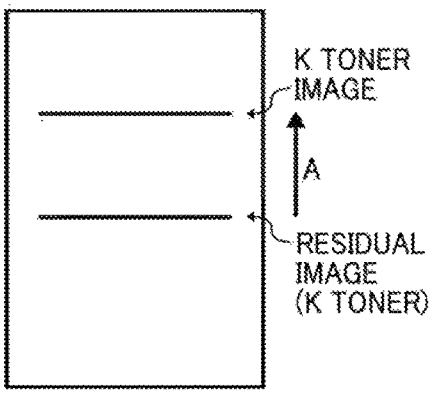
FIG. 4B is a diagram illustrating a state in which a residual image is generated by a first residual image generation pattern.
Figure 5A:
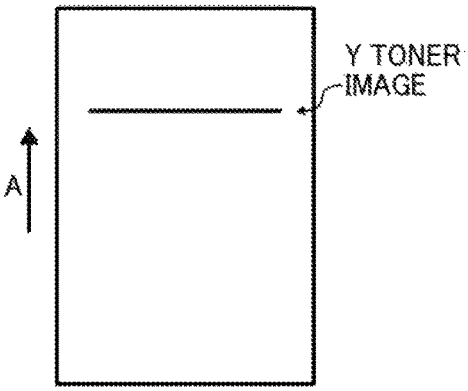
FIG. 5A is a diagram illustrating an image that is normally formed.
Figure 5B:
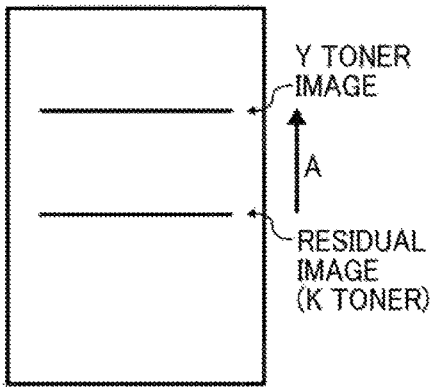
FIG. 5B is a diagram illustrating a state in which a residual image is generated by a second residual image generation pattern.

In the printer 200 according to the exemplary embodiment, there are two types of residual image generation patterns. FIGS. 4A and 4B illustrate a first residual image generation pattern, and FIGS. 5A and 5B illustrate a second residual image generation pattern. A residual transfer toner from each of the toner images formed on the photoconductors 2Y, 2C, 2M, and 2K remains as is on each of the photoconductors 2Y, 2C, 2M, and 2K. Such a residual transfer toner is primarily transferred to the intermediate transfer belt 7 with a toner image formed at the next rotation, causing generation of a residual image. The generation of such a residual image is illustrated as the first residual image generation pattern in FIGS. 4A and 4B. In the second residual image generation pattern illustrated in FIGS. 5A and 5B, for example, when a Y toner image dial is first and primarily transferred to the intermediate transfer belt 7 passes a K primary transfer nip positioned on a downstream side in a direction of surface movement of the intermediate transfer belt 7, a potential difference occurs on a surface of the photoconductor 2K by following the Y toner image. Such a potential difference causes generation of a residual image.

Figure 6:
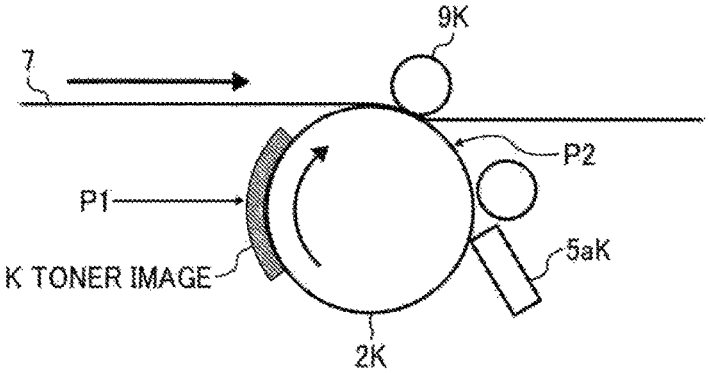
FIG. 6 is a diagram illustrating a black photoconductor for description of a process for generating the first residual image generation pattern.
Figure 7A:
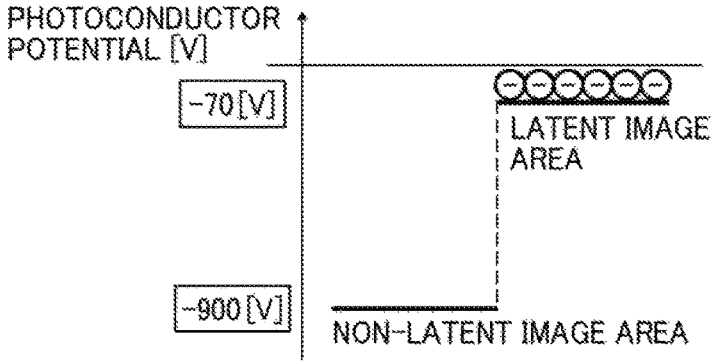
FIG. 7A is a schematic graph illustrating potential distribution on a surface of the black photoconductor prior to transfer.
Figure 7B:
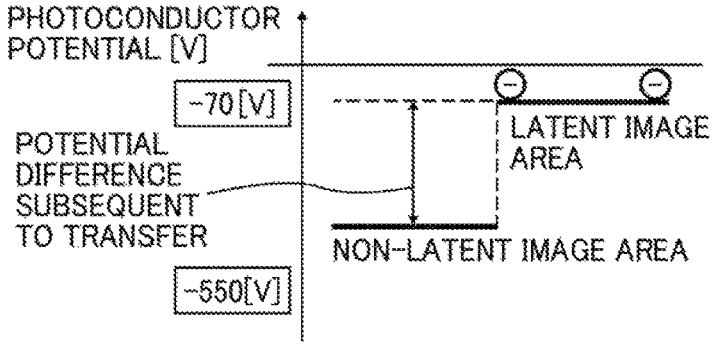
FIG. 7B is a schematic graph illustrating potential distribution on the surface of the black photoconductor subsequent to transfer.

FIG. 6 is a diagram of the photoconductor 2K for description of the first residual image generation pattern. FIG. 7A is a schematic graph illustrating potential distribution on the surface of the photoconductor 2K prior to transfer, and FIG. 7B is a schematic graph illustrating potential distribution on the surface of the photoconductor 2K subsequent to the transfer.

As illustrated in FIG. 6, when an image pattern including (1) a latent image area to which K toner adheres and a boundary between the latent image area and (2) a non-latent image area to which K toner does not adhere is primarily transferred, a surface potential of the photoconductor 2K is measured at a point P1 subsequent to development and prior to primary transfer. The surface potential measured at the point P1 is shown in FIG. 7A. The photoconductor 2K has a surface potential of approximately −900 V when uniformly charged by the charging roller 3Y. The optical writing unit 6 irradiates the uniformly charged surface of the photoconductor 2K with a laser beam, and the surface potential of the irradiated area (the latent image area) of the photoconductor 2K is decreased to approximately −70 V. The developing device 4K performs a developing process to allow the K toner having a negative polarity to adhere to the latent image area. As a result, as illustrated in FIG. 7A, the surface potential measured at the point P1 subsequent to the development and prior to primary transfer is approximately −900V in a non-latent image area of the photoconductor, and approximately −70 V in a latent image area with adhesion of toner.

When such a K toner image passes the primary transfer nip, the K toner image is primarily transferred to the intermediate transfer belt 7 by receiving, a primary transfer bias. FIG. 7B illustrates a photoconductor surface potential measured at a point P2 subsequent to the primary transfer and prior to cleaning. When the K toner image passes the primary transfer nip, the primary transfer bias allows a primary transfer current to flow from the primary transfer roller 9K to which a transfer voltage having a positive polarity is applied to the photoconductor 2K via the intermediate transfer belt 7. The flow of the primary transfer current shifts the potential of the non-latent image area on the surface of the photoconductor 2K subsequent to the transfer to a positive polarity, and thus the potential of the non-latent image area is decreased to approximately −550 V as illustrated in FIG. 7B. Since the potential of the latent image area on the surface of the photoconductor 2K subsequent to the transfer is already low, the potential of the latent image area cannot be further shifted to the positive polarity side. Hence, the potential remains at approximately −70V as illustrated in FIG. 7B.

As a result, as a difference in potential difference (unevenness) between the latent image area and the non-latent image area subsequent to the transfer is larger, a strong electric field is locally formed in a boundary (an edge portion) between the latent image area and the non-latent image area by a wraparound electric field. Accordingly, such an edge portion has a strong force that electrostatically attracts and holds the residual transfer toner (the excess toner) remaining on the photoconductor 2K subsequent to the primary transfer. The residual transfer toner held on the surface of the photoconductor 2K by the strong force tends to slip through a cleaning area in contact with the cleaning blade 5*a*K of a cleaner 5K. The residual transfer toner, which has slipped through the cleaning area, is retained on the surface of the photoconductor 2K as is even after a charging process, a latent image forming process, and a developing process of next image formation are performed. When passing the primary transfer nip next time, the residual transfer toner is primarily transferred to the intermediate transfer belt 7 by the primary transfer bias. Consequently, a residual image caused by the K toner is generated as illustrated in FIG. 4B.

Moreover, the formation of the strong localized electric field in the edge portion may not allow the potential (approximately −70 V) of the edge portion to be charged to approximately −900 V even if the next charging process is performed. In such a case, toner adheres to the edge portion in the next developing process even if the edge portion is a non-latent image area which is not irradiated with a laser beam in the next latent image forming process. As a result, when the toner adhering to the edge portion passes a next primary transfer nip, the toner is primarily transferred to the intermediate transfer belt 7 by the primary transfer bias. Consequently, a residual image caused by the K toner is generated as illustrated in FIG. 4B.

Figure 8:
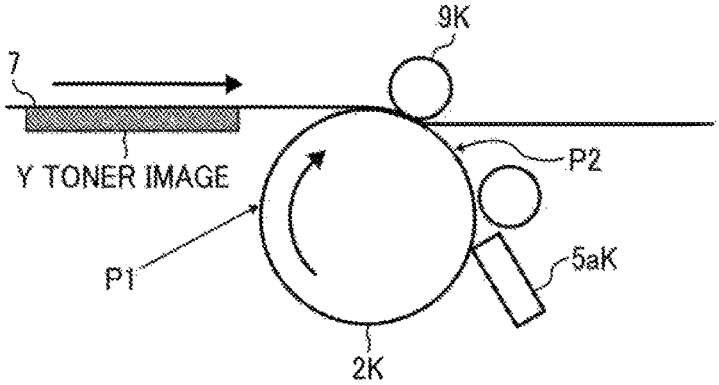
FIG. 8 is a diagram illustrating the black photoconductor for description of a process for generating the second residual image generation pattern.
Figure 9A:
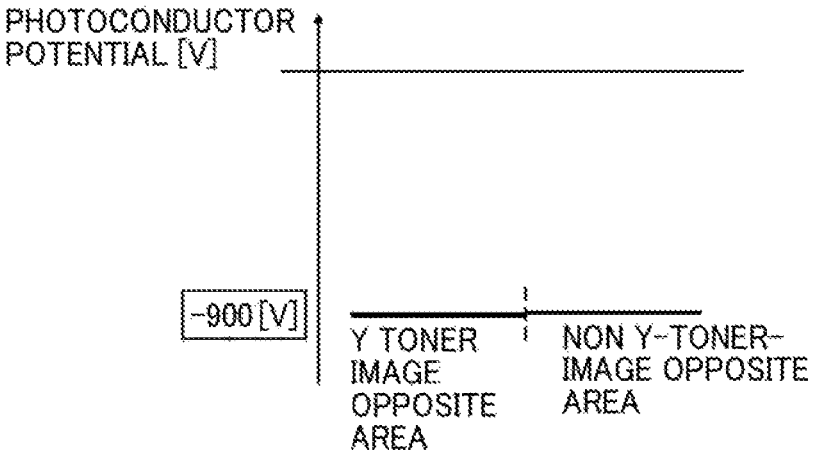
FIG. 9A is a schematic graph illustrating potential distribution on a surface of the black photoconductor prior to transfer.
Figure 9B:
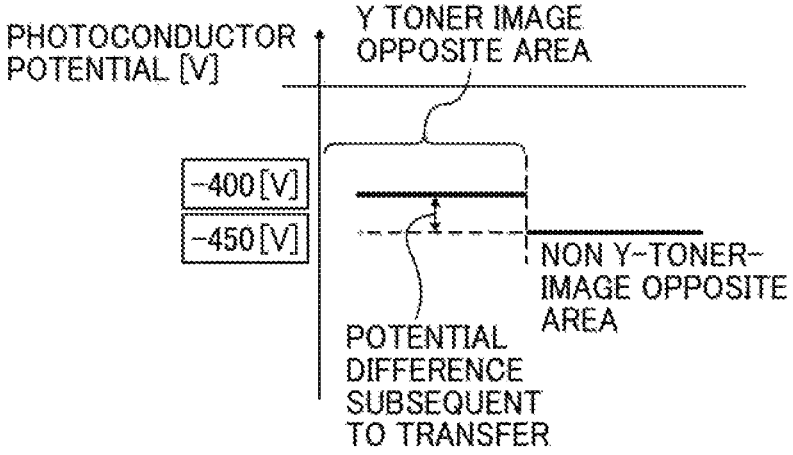
FIG. 9B is a schematic graph illustrating potential distribution on the surface of the black photoconductor subsequent to transfer.

FIG. 8 is a diagram of the photoconductor 2K for description of the process for generating the second residual image generation pattern. FIG. 9A is a schematic graph of potential distribution on the surface of the photoconductor 2K prior to transfer, and FIG. 9B is a schematic graph of potential distribution on the surface of the photoconductor 2K subsequent to the transfer.

As illustrated in FIG. 8, when a non-latent image area to which a K toner does not adhere passes a primary transfer nip, a toner image of another color (herein, a Y toner image) may pass the primary transfer nip, the Y toner image having been primarily transferred to the intermediate transfer belt 7 from the photoconductor 2Y positioned on an upstream side of the photoconductor 2K in a direction of surface movement of the intermediate transfer belt 7. In such a case, the photoconductor 2K at a point P1 illustrated in FIG. 8 has a uniform surface potential of approximately −900V subsequent to development and prior to primary transfer, since the non-latent image area is measured at the point P1. When such a non-latent image area passes a primary transfer nip, a primary transfer bias allows a primary transfer current to flow from the primary transfer roller 9K to which a transfer voltage having a positive polarity is applied to the photoconductor 2K via the intermediate transfer belt 7. Such flow of the primary transfer current shifts the surface potential of the photoconductor 2K subsequent to the transfer to a positive polarity, and the surface potential is decreased.

Herein, if the intermediate transfer belt 7 to pass the primary transfer nip for K has a Y toner image area with adhesion of a Y toner image and a non-Y-toner image area without adhesion of a Y toner image, an amount of primary transfer current flowing to the photoconductor 2K differs between the Y toner image area and the non-Y-toner image area. Particularly, the primary transfer current passing the Y toner image area is partially used for charge-up of the Y toner of the Y toner image, and thus an amount of the primary transfer current flowing to the photoconductor 2K is smaller than an amount of the primary transfer current passing the non-Y-toner image area by the amount used for the charge-up. Consequently, as illustrated in FIG. 9B, a decrease in a surface potential (approximately −400 V) of the photoconductor 2K in a Y toner image opposite area on the photoconductor 2K opposite the Y toner image on the intermediate transfer belt 7 is smaller than a decrease in a surface potential (approximately −450 V) of a non Y-toner-image opposite area on the photoconductor 2K not opposite the Y toner image on the intermediate transfer belt 7.

As described above, in the area (the edge portion) in which a change in the surface potential of the photoconductor subsequent to the transfer is large, a strong electric field is locally formed by a wraparound electric field. Accordingly, even in a boundary (an edge portion) between the Y toner image opposite area and the non Y-toner-image opposite area on the surface of the photoconductor 2K, the strong electric field can be locally formed by the wraparound electric field. In such an edge portion, the potential may not be changed to approximately −900V even if the next charging process is performed as described above. In such a case, toner adheres to the edge portion in the next developing process. When the edge portion with adhesion of the toner passes a next primary transfer nip, the toner is transferred to the intermediate transfer belt 7. Hence, a residual image caused by the K toner can be generated as illustrated in FIG. 5B.

In particular, since the indirect application transfer method is employed in the exemplary embodiment, a residual image by any of the above-described residual image generation patterns tends to be generated more readily than with the direct application transfer method. More particularly, an amount of transfer current flowing to the photoconductor can be normally larger in the direct application transfer method than the indirect application transfer method. Accordingly, in a case where the direct application transfer method is employed, the first residual image generation pattern allows a potential of a non-latent image area to be decreased by passage of a photoconductor surface through a primary transfer nip. Such a decrease in the potential decreases or substantially eliminates a potential difference (a potential unevenness) between the non-latent image area and a latent image area. Thus, a strong localized electric field is less likely to be formed in the edge portion, and a residual image does not tend to be generated.

On the other hand, in a case where the indirect application transfer method is employed, the first residual image generation pattern does not allow a potential of a non-latent image area to be adequately decreased by passage of a photoconductor surface through a primary transfer nip since an amount of transfer current in the indirect application transfer method is smaller than an amount of a transfer current in the direct application transfer method. Accordingly, a potential difference (a potential unevenness) between the non-latent image area and a latent image area is large. Hence, a strong electric field is locally formed in the edge portion, and a residual image tends to be generated.

Moreover, in a case where the direct application transfer method having a larger amount of transfer current is employed the second residual image generation pattern decreases a proportion of transfer current used for charge-up to transfer current flowing to a toner image of other colors when the toner image of the other color on the intermediate transfer belt 7 passes a primary transfer nip. The toner image of the other color herein has been primarily transferred to the intermediate transfer belt 7 from a photoconductor disposed on an upstream side in the direction of surface movement of the intermediate transfer belt 7. Hence, the transfer current also flows to an other-color-toner image opposite area (the Y toner image opposite area illustrated in FIG. 9A or 9B) opposite the toner image of the other color on the intermediate transfer belt 7 in the primary transfer nip. Herein, an amount of the transfer current flowing to the other-color-toner image opposite area is substantially the same as an amount of the transfer current flowing to a non other-color toner image opposite area (the non Y-toner-image opposite area illustrated in FIG. 9A or 9B). As a result, a potential difference (a potential unevenness) between the other-color-toner image opposite area and the non other-color toner image opposite area is decreased or substantially eliminated.

Therefore, a strong localized electric field is less likely to be formed in the edge portion, and a residual image does not tend to be generated.

On the other hand, in a case where the indirect application transfer method is employed, the second residual image generation pattern increases a proportion of transfer current used for charge-up to transfer current flowing to a toner image of other color since an amount of the transfer current in the indirect application transfer method is smaller than an amount of the transfer current in the direct application transfer method. Accordingly, an amount of the transfer current flowing to the other-color-toner image opposite area (the Y toner image opposite area illustrated in FIG. 9A or 9B) is significantly smaller than an amount of the transfer current flowing to the non other-color toner image opposite area (the non Y-toner-image opposite area illustrated in FIG. 9A or 9B). As a result, a potential difference (potential unevenness) between the other-color-toner image opposite area and the non other-color toner image opposite area is increased. Thus, a strong electric field is locally formed in the edge portion, and a residual image tends to be generated.

The above-described residual image tends to be generated under a condition (a residual image generation condition) that an image to be formed is an image pattern including a thin line image (that is, a toner image to be formed on the photoconductor by the first residual image generation pattern, and a toner image primarily transferred to the intermediate transfer belt 7 from the photoconductor on an upstream side in a direction of surface movement of the intermediate transfer belt 7 by the second residual image generation pattern). In the thin line image, a change in a surface potential of the photoconductor subsequent to the transfer occurs in an edge portion. Since the edge portions are close to each other in the thin line image, the residual image tends to be generated.

Moreover, the image forming apparatus may be installed under a condition (a residual image generation condition) that temperature of the installation environment is low. In such a case, the image forming apparatus is not adequately cleaned, and toner tends to slip through a cleaning area. In particular, under a condition (a residual image generation condition) that the temperature of a photoconductor is low, temperature of a cleaning blade is also low. Consequently, toner tends to slip through the cleaning area due to inadequate cleanability caused by the low temperature. Under such a residual image generation condition, a residual image particularly by the process for generating the first residual image generation pattern tends to be generated.

Moreover, when cleaning blades 5*a*Y, 5*a*C, 5*a*M and 5*a*K of respective cleaners 5Y, 5C, 5M, and 5K deteriorate over time, cleanability of each of the cleaning blades 5*a*Y, 5*a*C, 5*a*M, and 5*a*K becomes inadequate. Consequently, toner tends to slip through a cleaning area. Under a condition (a residual image generation condition) that an amount of usage of each of the cleaning blades 5*a*Y, 5*a*C, 5*a*M, and 5*a*K (e.g., a relative travel distance of the cleaning blade with respect to a photoconductor surface) exceeds a prescribed amount, a residual image particularly by the process for generating the aforementioned first residual image generation pattern tends to be generated.

Moreover, a residual image tends to be generated under a condition (a residual image generation condition) that an image pattern allows the above-described toner image formed on the intermediate transfer belt 7 by overlapping toner images of two or more colors to pass a primary transfer nip. When the toner image including the overlapped toner images of two or more colors on the intermediate transfer belt 7 passes a primary transfer nip, a proportion of primary transfer current used for charge-up of the toner to primary transfer current passing the toner image area in the primary transfer nip becomes larger. Accordingly, under the residual image generation condition that such an image pattern is formed, a residual image particularly by the process for generating the aforementioned second residual image generation pattern tends to be generated.

In a slate in which such a residual image generation condition is satisfied, that is, a residual image tends to be generated, an increase in surface potential unevenness of the photoconductor subsequent to the transfer causes generation of a residual image by the process for generating the first residual image generation pattern or the process for generating the second residual image generation pattern described above.

Figure 10:
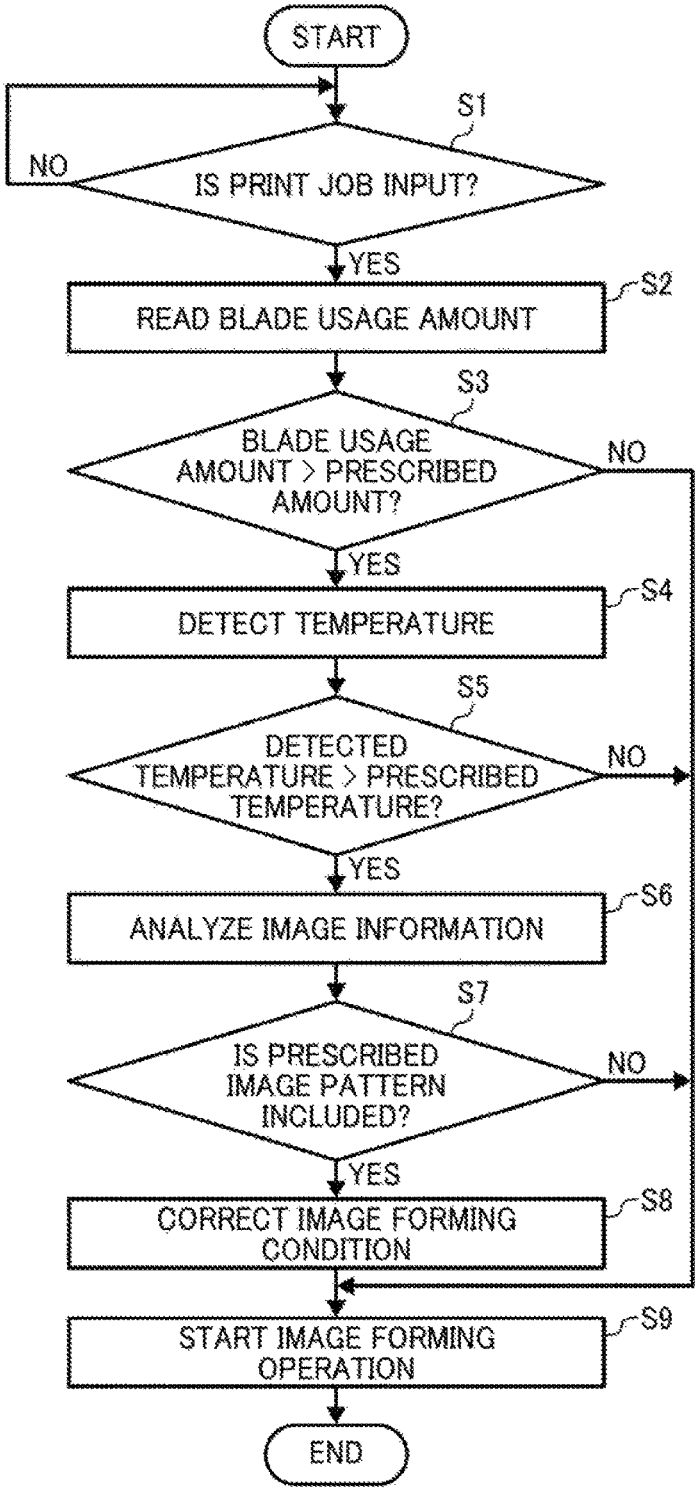
FIG. 10 is a flowchart of a residual image prevention process according to the exemplary embodiment.

Next, a residual image prevention process according to the exemplary embodiment is described with reference to a flowchart illustrated in FIG. 10.

In the exemplary embodiment a controller 100 starts the residual image prevention process each time a prescribed execution time comes, for example, each time a print job is input. When a print job is input (YES in step S1), the process proceeds to step S2 in which the controller 100 reads blade usage information stored in a predetermined storage unit. In step S3, the controller 100 determines whether a blade usage amount indicated by the blade usage information exceeds a prescribed amount. The blade usage information of the exemplary embodiment includes information indicating a photoconductor travel distance that has been cumulated since the beginning of use of each of the current cleaning blades 5*a*Y, 5*a*C, 5*a*M, and 5*a*K. That is, the blade usage information indicates relative travel distances of the cleaning blades 5*a*Y, 5*a*C, 5*a*M, and 5*a*K of the respective cleaners 5Y, 5C, 5M, and 5K and the surfaces of the respective photoconductors 2Y, 2C, 2M, and 2K. Although such blade usage information is used in the exemplary embodiment, other information may be used as long as information indicates usage amounts of the cleaners 5Y, 5C, 5M, and 5K.

As described above, if the blade usage amount exceeds the prescribed amount, toner tends to slip through the cleaning area. Moreover, if surface potential unevenness of the photoconductor subsequent to transfer is large, a residual image particularly by the process for generating the aforementioned first residual image generation pattern tends to be generated. On the other hand, the blade usage amount may not exceed the prescribed amount, in such a case, a residual image does not tend to be generated even if surface potential unevenness of the photoconductor subsequent to transfer is large. Accordingly, in the exemplary embodiment, if the blade usage amount does not exceed the prescribed amount (NO in step S3), the process proceeds to step in winch the primer 200 starts an image forming operation under the normal image forming conditions without correcting the image forming condition. In the exemplars embodiment, the prescribed amount is set to a half of a predetermined life span usage that is reached when each of the cleaning blades 5*a*Y, 5*a*C, 5*a*M, and 5*a*K reaches the end of life. However, the prescribed amount can be appropriately adjusted.

Even if the blade usage amount exceeds the prescribed amount (YES in step S3), a residual image does not tend to be generated as long as temperature of the installation environment of the image forming apparatus is high (particularly, temperature of the photoconductor). The high temperature environment enables the cleaning blade to maintain adequate cleanability, and toner does not tend to slip through a cleaning area. Hence, even if the surface potential unevenness of the photoconductor subsequent to transfer is large, a residual image does not tend to be generated. Accordingly, in the exemplary embodiment, if the blade usage amount does not exceed the prescribed amount (NO in step S3), and temperature detected by a temperature sensor does not exceed a prescribed temperature (step S4, NO in step S5), the process proceeds to step S9 in which the printer 200 starts an image forming operation under the normal image forming conditions without correcting the image forming condition.

In the exemplary embodiment, the process units 1Y, 1C, 1M, and 1K include the respective temperature sensors to detect temperature near the photoconductors 2Y, 2C, 2M, and 2K. However, the temperature sensor may detect temperature of another area. The prescribed temperature in the exemplary embodiment is set to 15° C. but is not limited thereto, and may be appropriately adjusted.

FIG. 11 is a graph illustrating an area in which an image forming operation is executed under the normal image forming conditions and an area in which the image forming operation is executed under corrected image forming conditions. In the graph illustrated in FIG. 11, a horizontal axis indicates blade usage, and a vertical axis indicates detected temperature.

Even if the blade usage amount exceeds the prescribed amount (YES in step S3), and the detected temperature exceeds the prescribed temperature (YES in step S5), a residual image may not be generated. For example, an image to be formed may not include a prescribed image pattern by which a residual image tends to generated. In such a case, even if surface potential unevenness of the photoconductor subsequent to transfer is large, a residual image does not tend to be generated. The phrase "prescribed image pattern by which a residual image tends to be generated" used herein includes, for example, an image pattern including the above-described thin line image, and an image pattern allowing the above-described toner image formed on the intermediate transfer belt 7 by overlapping toner images of two or more colors to pass a primary transfer nip. The term "thin line image" used herein includes an image area with a length "a" in a sub-scanning direction indicated by an arrow A shown in FIGS. 12A and 12B (a direction opposite the direction of surface movement of the intermediate transfer belt) of a prescribed length (e.g., 12 dots if the image has 600 dots per inch (dpi)) or less.

In the exemplary embodiment, even if the blade usage amount exceeds the prescribed amount (YES in step S3), and the detected temperature exceeds the prescribed temperature (YES in step S5), the image to be formed may not include the prescribed image pattern based on image information analysis in step S6 (No in step S7). In such a case, in step S9, the printer 200 starts an image forming operation under the normal image forming conditions without correcting the image forming conditions. In the process for determining whether the image to be formed include the prescribed image pattern, for example, the controller 100 acquires image information about the input print job and analyzes the acquired image information to determine whether the prescribed image pattern is included.

On the other hand, if the blade usage amount exceeds the prescribed amount (YES in step S3), the detected temperature exceeds the prescribed temperature (YES in step S5), and the image to be formed includes the prescribed image pattern (YES in step S7), the process proceeds to step S8. In step S8, the controller 100 determines that a residual image generation condition is satisfied, and corrects the image forming condition such that a residual image does not tend to be generated. Particularly, if the residual image generation condition is satisfied, the controller 100 corrects the image forming conditions such that surface potential unevenness of each of the photoconductors 2Y, 2C, 2M, and 2K subsequent to the transfer is smaller than potential unevenness provided when an image is formed under the normal image conditions.

In the exemplary embodiment, the controller 100 corrects the image forming condition as illustrated in FIG. 13. In the normal image forming conditions, an upper limit of an absolute value of the photoconductor charging potential charged by each of the charging rollers 3Y, 3C, 3M and 3K is set to 900V. If the residual image generation condition is satisfied, the controller 100 corrects the image forming condition such that the upper limit of the photoconductor charging potential is 700V. Such a correction does not allow the absolute value of the photoconductor charging potential to be set to a value exceeding 700V as long as the residual image generation condition is satisfied even if the photoconductor charging potential charged by each of the charging rollers 3Y, 3C, 3M, and 3K is controlled by image quality control (process control).

Therefore, the controller 100 corrects the photoconductor charging potential such that an absolute value of the photoconductor charging potential is not increased. Such a correction suppresses an increase in a potential difference (charging unevenness) between a potential of a non-latent image area and a potential of a latent image area on the surface of the photoconductor prior to transfer. Hence, an increase in a potential difference (charging unevenness) between a potential of the non-latent image area and a potential of the latent image area subsequent to the transfer is also suppressed, thereby suppressing generation of a strong localized electric field in a boundary (an edge portion) between the non-latent image area and the latent image area. As a result, generation of a residual image by the process for generating the aforementioned first residual image generation pattern is suppressed.

In the exemplary embodiment, moreover, the controller 100 corrects primary transfer voltage as illustrated in FIG. 13. In the normal image forming conditions, a primary transfer voltage is set to +1400V. If the residual image generation condition is satisfied, the controller 100 corrects the primary transfer voltage to +1300V. Such a decrease in the primary transfer voltage by the correction decreases an amount of primary transfer current flowing to a primary transfer nip to an amount smaller than an amount of primary transfer current flowing under the normal image forming conditions. Therefore, when a toner image of other color primarily transferred from the photoconductor on an upstream side in the direction of surface movement of the intermediate transfer belt 7 passes the primary transfer nip, a proportion of the transfer current for charge-up to the transfer current flowing to the toner image of the other color is decreased. As a result, a difference between an amount of the transfer current flowing to the other-color-toner image opposite area (the Y-toner image opposite area illustrated in FIG. 9A or 9B) and an amount of the transfer current flowing to the non other-color loner image opposite area (the non Y-toner-image opposite area illustrated in FIG. 9A or 9B) becomes smaller. The other-color-toner image opposite area is an area opposite the toner image of the other color on the intermediate transfer belt 7 in the primary transfer nip, whereas the non other-color toner image opposite area is an area not opposite the toner image of the other color. Accordingly, a potential difference (potential unevenness) between a potential of the other-color-toner image opposite area and a potential of the non other-color toner image opposite area becomes smaller, thereby suppressing generation of a strong localized electric field in the edge portion and generation of a residual image due to process for generating the aforementioned second residual image generation pattern.

In the exemplary embodiment, the term "residual image generation condition" represents any one or more of a condition that a blade usage amount exceeds a prescribed amount, a detected temperature exceeds a prescribed temperature, and an image to be formed includes a prescribed image pattern. However, the residual image generation condition is not limited thereto. The residual image generation condition may be appropriately set. For example, the controller 100 can determine that a residual image generation condition is satisfied if any one of the following conditions is satisfied: a blade usage amount exceeds a prescribed amount; a detected temperature exceeds a prescribed temperature; and an image to be formed includes a prescribed image pattern. The residual image generation condition can be any conditions other than the conditions described in the exemplary embodiment as long as a condition indicates a state in which a residual image tends to be generated.

The printer 200 serving as one example of an image forming apparatus can provide the effects described below. Not all of these effects need be present, nor are they limited to the following description.

(Aspect A)

An image forming apparatus includes a latent image bearer such as the photoconductors 2Y, 2C, 2M, and 2K, a charger such as the charging rollers 3Y, 3C, 3M, and 3K, a latent image forming unit such as the optical writing unit 6, a developing unit such as the developing devices 4Y, 4C, 4M, and 4K, a receiver unit such as the intermediate transfer belt 7, a transfer unit such as the primary transfer rollers 9Y, 9C, 9M, and 9K, an information acquisition unit such as a photoconductor travel distance counter, a temperature sensor, and the controller 100, and a correction unit such as the controller 100. The latent image bear makes a surface movement, and the charger performs a charging process to charge a surface of the latent image bearer with a predetermined charging potential. The latent image forming unit forms, based on image information, an electrostatic latent image on the surface of the image bearer subsequent to the charging process. The developing unit allows toner to adhere to the electrostatic latent image on the surface of the latent image bearer to form a toner image. The receiver unit receives the toner image from the surface of the latent image bearer. The transfer unit applies a predetermined transfer bias such as a primary transfer bias between the latent image bearer and the receiver unit to transfer the toner image on the surface of the latent image bearer to the receiver unit.

The information acquisition unit acquires residual image generation determination information such as a blade usage amount, a detected temperature, and an image pattern for determination of whether a predetermined residual image generation condition is satisfied. If the image forming apparatus determines that the predetermined residual image generation condition is satisfied based on the residual image generation determination information acquired by the information acquisition unit, the correction unit corrects an image forming condition such that surface potential unevenness of the latent image bearer subsequent to transfer is smaller than surface potential unevenness generated where the predetermined residual image generation condition is not satisfied.

A phenomenon called a residual image tends to occur under a specific residual image generation condition such that an image to be formed includes an image pattern such as a thin line image and temperature of installation environment of the image forming apparatus is low. Moreover, the image forming apparatus include a cleaner to clean excess toner adhering to the surface of the latent image bearer subsequent to transfer. When the cleaner deteriorates over time, a residual image tends to be generated. Moreover, the image forming apparatus allows a plurality of toner images to be overlapped and transferred to the receiver unit. When the image forming apparatus forms an image pattern including an image area in which two or more toner images overlap, a residual image tends to be generated.

The residual image is generated when there are large differences between the surface potential of the latent image bearer subsequent to transfer under the above-described conditions. Particularly, the latent image bearer has an area in which surface potential unevenness subsequent to transfer is large, and a strong electric field is locally formed in such an area by a wraparound electric field. That is, the strong localized electric field is formed in a boundary between art area in which surface potential of the latent image bearer subsequent to transfer is relatively large and an area in which surface potential of the latent image bearer subsequent to transfer is relatively small. Since such an area has a strong force for holding excess toner on the latent image bearer, the excess toner remains on the surface of the latent image bearer until next transfer. Consequently, the residual toner is transferred to the receiver unit at the next transfer, causing generation of a residual image.

According to the aspect A, if the image forming apparatus of the present embodiment determines that the predetermined residual image generation condition is satisfied based on the residual image generation determination information acquired by the information acquisition unit, the correction units correct the image forming condition such that the surface potential unevenness of the latent image bearer subsequent to transfer is smaller than surface potential unevenness generated where the predetermined residual image generation condition is not satisfied. Therefore, even in a state in which the residual image generation condition is satisfied, the local electric field in the boundary is weakened, thereby weakening the force for holding the excess toner to the latent image bearer. As a result, the image forming apparatus prevents a case in which the excess toner remains on the surface of the latent image bearer until next transfer, thereby suppressing generation of a residual image.

(Aspect B)

In the image forming apparatus with the aspect A, the receiver unit is the intermediate transfer belt 7 of an endless belt that extends across a plurality of rollers including a transfer roller such as the primary transfer rollers 9Y, 9C, 9M, and 9K. The transfer roller is disposed such that a point A2 on the surface of the latent image bearer is positioned on a downstream side of a point A1 on the surface of the latent image bearer in a direction of surface movement of the latent image bearer. The point A2 is provided on a virtual line L2 connecting a surface curvature center O1 of the latent image bearer to a rotation center O2 of the transfer roller on a virtual surface perpendicular to the direction of surface movement of the latent image bearer. The point A1 on the surface of the latent image bearer is nearest to the intermediate transfer belt in a state in which the transfer roller is not disposed. In such an image forming apparatus, the transfer unit applies the transfer bias between the transfer roller and the latent image bearer. Since the image forming apparatus with the aspect B employs the indirect application transfer method, the aforementioned advantages can be more readily obtained than with employment of the direct application transfer method. However, an amount of transfer current flowing to a transfer nip is smaller in the indirect application transfer method than the direct application transfer method, and a residual image tends to be generated. According to the aspect B, the image forming apparatus can obtain the advantages of the indirect application method while suppressing generation of the residual image.

(Aspect C)

In the image forming apparatus with the aspect A or B, the residual image generation determination information includes environment information indicating installation environment of the image forming apparatus. As described above, the environment information indicating installation environment of the image forming apparatus is useful for determination of whether the image forming apparatus is in a state in which a residual image tends to be generated. Therefore, according to the aspect C, the image forming apparatus can appropriately determine whether the predetermined residual image generation condition is satisfied.

(Aspect D)

In the image forming apparatus with the aspect C, the environment information includes temperature information indicating temperature of the latent image bearer. As described above, the temperature information indicating temperature of the latent image bearer is useful for determination of whether the image forming apparatus is in a state in which a residual image tends to be generated. Thus, according to the aspect D, the image forming apparatus can appropriately determine whether the predetermined residual image generation condition is satisfied.

(Aspect E)

The image forming apparatus with any of the aspects A though D includes a cleaner such as the cleaners 5Y, 5C, 5M, and 5K. The cleaner cleans excess toner such as residual transfer toner adhering to the surface of the latent image bearer subsequent to transfer performed by the transfer unit. In the image forming apparatus with any of the aspects A though D, the residual image generation determination information includes usage information indicating an amount of usage of the cleaner. As described above, such usage information is useful for determination of whether the image forming apparatus is in a state in which a residual image tends to be generated. Thus, according to the aspect E, the image forming apparatus can appropriately determine whether the predetermined residual image generation condition is satisfied.

(Aspect F)

In the image forming apparatus with any of the aspects A though E, the residual image generation determination information includes image pattern information that is acquired from the image information. As described above, the image pattern information of an image to be formed is useful for determination of whether the image forming apparatus is in a state in which a residual image tends to be generated. According to the aspect F, therefore, the image forming apparatus can appropriately determine whether the predetermined residual image generation condition is satisfied.

(Aspect G)

In the image forming apparatus with the aspect F, the image pattern information indicates an image pattern including a thin line. As described above, when the image pattern includes a thin line, a residual image tends to be generated. Thus, according to the aspect G, the image forming apparatus can appropriately determine whether the predetermined residual image generation condition is satisfied.

(Aspect H)

The image forming apparatus with the aspect F or G includes a plurality of latent image bearers and a plurality of transfer units that transfer toner images formed on the plurality of respective latent image bearers such that the toner images overlap one another on the receiver unit. The image pattern information indicates an image pattern including an image area in which toner images formed on surfaces of the two or more latent image bearers overlap. As described above, when the image pattern includes such an overlap image area, a residual image tends to be generated. According to the aspect H, the image forming apparatus can appropriately determine whether the predetermined residual image generation condition is satisfied.

(Aspect I)

In the image forming apparatus with any of the aspects A through H, a time when the information acquisition unit acquires the residual image generation determination information includes a time when the image information is acquired. Accordingly, in a case where the residual image generation condition is satisfied, the image forming condition can be corrected before an image forming operation is started based on the acquired image information. Thus, the image forming apparatus can effectively prevent generation of an image including a residual image.

Aspect J

In the image forming apparatus with any of the aspects A through I, the image forming condition to be corrected by the correction unit includes at least one of the predetermined charging potential and the predetermined transfer bias. As described above, since the correction of the charging potential or the transfer bias can suppress generation of a residual image, the image forming apparatus according to the aspect J can effectively prevent generation of an image including a residual image.

The present disclosure has been described above with reference to specific exemplary embodiments but is not limited thereto. Various modifications and enhancements are possible without departing from scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. An image forming apparatus comprising:

a latent image bearer to make a surface movement;

a charger to perform a charging process to charge a surface of the latent image bearer with a predetermined charging potential;

a latent image forming unit to form, based on image information, an electrostatic latent image on the surface of the image bearer subsequent to the charging process;

a developing unit to allow toner to adhere to the electrostatic latent image on the surface of the latent image bearer to form a toner image;

a receiver unit to receive the toner image from the surface of the latent image bearer;

a transfer unit to apply a predetermined transfer bias between the latent image bearer and the receiver unit to transfer the toner image on the surface of the latent image bearer to the receiver unit;

an information acquisition unit to acquire residual image generation determination information for determination of whether a predetermined residual image generation condition is satisfied;

a correction unit to correct an image forming condition such that surface potential unevenness of the latent image bearer subsequent to transfer is smaller than surface potential unevenness generated where the predetermined residual image generation condition is not satisfied, when the image forming apparatus determines that the predetermined residual image generation condition is satisfied based on the residual image generation determination information acquired by the information acquisition unit; and a cleaner to clean excess toner adhering to the surface of the latent image bearer subsequent to transfer performed by the transfer unit, wherein the residual image generation determination information includes at least usage information indicating an amount of usage of the cleaner in cleaning the excess toner adhering to the surface of the latent image bearer.

2. The image forming apparatus according to claim 1, wherein the receiver unit is an endless intermediate transfer belt extending across a plurality of rollers including a transfer roller, wherein the transfer roller is disposed such that a second point on the surface of the latent image bearer is positioned on a downstream side of a first point on the surface of the latent image bearer in a direction of surface movement of the latent image bearer, the second point being provided on a virtual line connecting a surface curvature center of the latent image bearer to a rotation center of the transfer roller on a virtual surface perpendicular to the direction of surface movement of the latent image bearer, whereas the first point being provided nearest to the intermediate transfer belt in a state in which the transfer roller is not disposed, and wherein the transfer unit applies the transfer bias between the transfer roller and the latent image bearer.

3. The image forming apparatus according to claim 2, wherein the intermediate transfer belt is disposed above the latent image bearer in a gravitational direction.

4. The image forming apparatus according to claim 1, wherein the residual image generation determination information includes environment information indicating installation environment of the image forming apparatus.

5. The image forming apparatus according to claim 4, further comprising a temperature sensor to sense a temperature of the latent image bearer, wherein the environment information includes temperature information indicating the temperature of the latent image bearer.

6. The image forming apparatus according to claim 1, wherein the residual image generation determination information includes image pattern information acquired from the image information.

7. The image forming apparatus according to claim 6, wherein the image pattern information indicates an image pattern including a thin line.

8. The image forming apparatus according to claim 6 comprising:

a plurality of latent image bearers including the latent image bearer; and a plurality of transfer units including the transfer unit to transfer toner images formed on the plurality of respective latent image bearers such that the toner images overlap one another on the receiver unit, wherein the image pattern information indicates an image pattern including an overlap image area in which toner images formed on surfaces of two or more latent image bearers of plurality of latent image bearers overlap one another.

9. The image forming apparatus according to claim 1, wherein a time when the information acquisition unit acquires the residual image generation determination information includes a time when the image information is acquired.

10. The image forming apparatus according to claim 1, wherein the image forming condition to be corrected by the correction unit includes at least one of the predetermined charging potential and the predetermined transfer bias.

11. The image forming apparatus according to claim 1, wherein the cleaner is one or more cleaning blades.

12. The image forming apparatus according to claim 11, wherein the usage information indicates a relative travel distances of the one or more cleaning blades.

* * * * *